US009074599B2

(12) United States Patent
Collie

(10) Patent No.: US 9,074,599 B2
(45) Date of Patent: Jul. 7, 2015

(54) SCROLL COMPRESSOR HAVING ADJUSTABLE SPACERS

(71) Applicant: Edwards Limited, Crawley, West Sussex (GB)

(72) Inventor: Clive Frederick Collie, Elstree (GB)

(73) Assignee: Edwards Limited, Crawley (GB)

( * ) Notice: Subject to any disclaimer, the term of this patent is extended or adjusted under 35 U.S.C. 154(b) by 0 days.

(21) Appl. No.: 14/061,702

(22) Filed: Oct. 23, 2013

(65) Prior Publication Data

US 2014/0044582 A1 Feb. 13, 2014

Related U.S. Application Data

(63) Continuation of application No. 12/623,520, filed on Nov. 23, 2009, now Pat. No. 8,591,210.

(30) Foreign Application Priority Data

Dec. 19, 2008 (GB) ..... 0823184.7

(51) Int. Cl.

| | |
|---|---|
| ***F03C 2/00*** | (2006.01) |
| ***F03C 4/00*** | (2006.01) |
| ***F04C 18/00*** | (2006.01) |
| ***F04C 2/00*** | (2006.01) |
| ***F04C 18/02*** | (2006.01) |
| ***F04C 27/00*** | (2006.01) |
| F01C 1/02 | (2006.01) |
| ***F01C 21/10*** | (2006.01) |
| *F04C 23/00* | (2006.01) |

(52) U.S. Cl.

CPC ..... *F04C 18/0215* (2013.01); *Y10T 29/4924* (2015.01); *Y10T 29/49238* (2015.01); *F04C 27/005* (2013.01); *F01C 1/0253* (2013.01); *F04C 23/008* (2013.01); *F01C 1/0215* (2013.01); *F04C 27/007* (2013.01); *F04C 2230/601* (2013.01); *F04C 2230/603* (2013.01); *F04C 2230/70* (2013.01); *F04C 2230/60* (2013.01); *F01C 21/102* (2013.01)

(58) Field of Classification Search

CPC .. F04C 18/0215; F04C 23/008; F04C 27/005; F04C 27/007; F04C 2230/60; F04C 2230/601; F04C 2230/203; F04C 2230/604; F04C 2230/70; F04C 2230/603; F01C 1/0215; F01C 1/0253; F01C 21/102

USPC ..... 418/55.1–55.6, 57, 104, 149, 1

See application file for complete search history.

(56) References Cited

U.S. PATENT DOCUMENTS 4,649,611 A 3/1987 Ikeda et al.

(Continued)

FOREIGN PATENT DOCUMENTS

EP 0780576 A2 6/1997
EP 0780576 A3 12/1998

(Continued)

*Primary Examiner* — Theresa Trieu

(74) *Attorney, Agent, or Firm* — Shumaker & Sieffert, P.A.

(57) ABSTRACT

A scroll compressor 40 comprises: housing 12, orbiting scroll 26 and fixed scroll 41. The drive shaft 14 has an eccentric shaft portion 18 so that rotation of the eccentric shaft portion imparts an orbiting motion to the orbiting scroll relative to the fixed scroll. Axial spacers 42 are located between the fixed scroll and the housing for spacing the fixed scroll relative to the orbiting scroll. When the scroll compressor 40 is assembled and tested and it is desired to perform shimming, the fixed scroll can be removed and a selected spacer placed in position prior to re-assembling the fixed scroll.

5 Claims, 3 Drawing Sheets

(56) References Cited

U.S. PATENT DOCUMENTS

| | | | |
|---|---|---|---|
| 4,731,000 | A | 3/1988 | Haag |
| 5,411,384 | A | 5/1995 | Bass et al. |
| 5,445,507 | A | 8/1995 | Nakamura et al. |
| 6,039,549 | A | 3/2000 | Tarng et al. |

FOREIGN PATENT DOCUMENTS

| | | | |
|---|---|---|---|
| EP | 1433956 | A1 | 6/2004 |
| JP | 07019184 | A | 6/1993 |
| JP | 09053574 | A | 8/1995 |
| JP | 09032752 | A | 2/1997 |
| JP | 2007192196 | A | 1/2006 |
| JP | 2006-046078 | | 2/2006 |

SCROLL COMPRESSOR HAVING ADJUSTABLE SPACERS

This application is a continuation of U.S. patent application Ser. No. 12/623,520, filed Nov. 23, 2009, which claims priority to G.B. Patent Application No. 0823184.7, filed Dec. 19, 2008. The entire contents of U.S. patent application Ser. No. 12/623,520 and G.B. Patent Application No. 0823184.7 are incorporated herein by reference.

FIELD OF THE INVENTION

The present invention relates to a scroll compressor.

BACKGROUND

A prior art scroll compressor 10 is shown in FIG. 5, and comprises a housing 12, a drive shaft 14 having a concentric shaft portion 16 and an eccentric shaft portion 18. The shaft 14 is supported at its concentric portion by bearings 20, which are fixed relative to housing 12, and driven by a motor 22. Second bearings 24 support an orbiting scroll 26 on the eccentric shaft portion 18 so that during use rotation of the shaft imparts an orbiting motion to the orbiting scroll 26 relative to a fixed scroll 28 for pumping gaseous fluid along a fluid flow path 30 between an inlet 31 and outlet 33 of the compressor.

Each scroll comprises a scroll wall 32, 34 which extends perpendicularly to a generally circular base plate 27, 29. The orbiting scroll wall 32 co-operates with the fixed scroll wall 34 during orbiting movement of the orbiting scroll. Scroll pumps are dry pumps and therefore the clearances between the scrolls must be accurately set during manufacture or adjustment to minimize seepage of fluid through the clearances. The phrase "dry pump" is well known in the art and is generally understood to mean a pump which does not contain any sealing or lubricating fluids exposed directly to vacuum in the pumping chamber.

In more detail, the space between the axial ends of a scroll wall of one scroll and the base plate of the other scroll is sealed by tip seals 36, but in order to allow the tip seals to seal effectively and to avoid excessive wear, the axial spacing between the orbiting scroll and the fixed scroll must be accurately controlled.

As the components of the compressor are manufactured within tolerances it is necessary when assembling the compressor to adjust the spacing between the orbiting scroll and fixed scroll to produce correct spacing in the axial direction. This procedure is commonly referred to as 'shimming'.

In FIG. 5, the orbiting scroll is spaced from the fixed scroll with a spacer 38 positioned between a stepped portion of the drive shaft 14 and bearings 24. The spacer is generally circular and extends around a circumference of the eccentric portion 18 of the drive shaft. The axial thickness of the spacer 38 is selected to produce correct positioning of the orbiting scroll in an axial direction. When a spacer is located as shown the position of the orbiting scroll is shifted to the left in FIG. 5.

The FIG. 5 arrangement suffers from a numbers of problems. First, in order to determine if shimming is required it is normally necessary to inspect the compressor when it is partially or fully assembled. If adjustment of the spacing between the scrolls is required, it is necessary first to remove the fixed scroll, and then to remove the orbiting scroll. Subsequently, the bearing 24 must be removed and then finally a selected spacer can be located as shown in FIG. 5. Following this procedure the parts must be re-assembled and the compressor tested. If shimming is not correct, the procedure must be repeated. It will be appreciated that this process is unduly time consuming. It should also be noted that the procedure of removing and replacing parts of the compressor, such as the bearings 24 and the orbiting scroll 26, can in itself introduce small misalignments in the axial spacing of the orbiting scroll and the fixed scroll.

Secondly, the spacer itself must be accurately manufactured if it is not to produce misalignments within the compressor when it is inserted between the drive shaft 14 and the bearings 24. That is, if the end faces of the spacer are not parallel to each other, when the spacer is located in position it causes angular displacement of the orbiting scroll. Such angular displacement is referred to as swash. Swash causes an angle to be created between the scroll walls and consequently reduces efficiency as fluid is allowed to seep between the walls. Swash may also cause irregular spacing between the tip seals and the opposing scroll. The problems resulting from swash are further exacerbated because the spacer 38 is located relatively close in the radial direction to the central axis C of the compressor. Accordingly, if the end faces of the spacer are not parallel it produces a relatively large angular misalignment of the orbiting scroll.

The present invention seeks at least to mitigate one or more of the problems associated with the prior art.

SUMMARY

The present invention provides a scroll compressor comprising: a housing; an orbiting scroll; a fixed scroll; a drive shaft having an eccentric shaft portion so that rotation of the eccentric shaft portion imparts an orbiting motion to the orbiting scroll relative to the fixed scroll; and at least one axial spacer located between the fixed scroll and the housing for spacing the fixed scroll relative to the orbiting scroll in an axial direction.

The present invention also provides a method of assembling a scroll compressor, the method comprising the steps carried out sequentially of: supporting an orbiting scroll relative to an eccentric shaft portion of a drive shaft in a housing of the scroll compressor; locating at least one selected axial spacer in position relative to the housing or the fixed scroll; and fixing the fixed scroll to the housing such that a spacing in an axial direction and/or an angular alignment between the fixed scroll and the orbiting scroll is determined by an axial thickness of the at least one axial spacer.

The present invention also provides a method of adjusting a spacing in an axial direction and/or angular alignment between a fixed scroll and an orbiting scroll of a scroll compressor, the method comprising: removing a fixed scroll from a housing of the scroll compressor; replacing one or more axial spacers between the housing and the fixed scroll with one or more axial spacers of different axial thickness; and fixing the fixed scroll to the housing.

The present invention also provides a kit for assembling a scroll compressor comprising: a housing; an orbiting scroll; a fixed scroll; a drive shaft having an eccentric shaft portion so that rotation of the eccentric shaft portion imparts an orbiting motion to the orbiting scroll relative to the fixed scroll; and a plurality of axial spacers of different axial thickness for spacing in an axial direction and/or angularly aligning said fixed scroll and said orbiting scroll, wherein one or more selected axial spacers can be located between said fixed scroll and said housing for correctly spacing and/or angularly aligning said fixed scroll and said orbiting scroll.

Other preferred and/or optional aspects of the invention are defined in the accompanying claims.

BRIEF DESCRIPTION OF THE DRAWINGS

In order that the present invention may be well understood, an embodiment thereof, which is given by way of example only, will now be described with reference to the accompanying drawings, in which.

DETAILED DESCRIPTION

Figure 1:
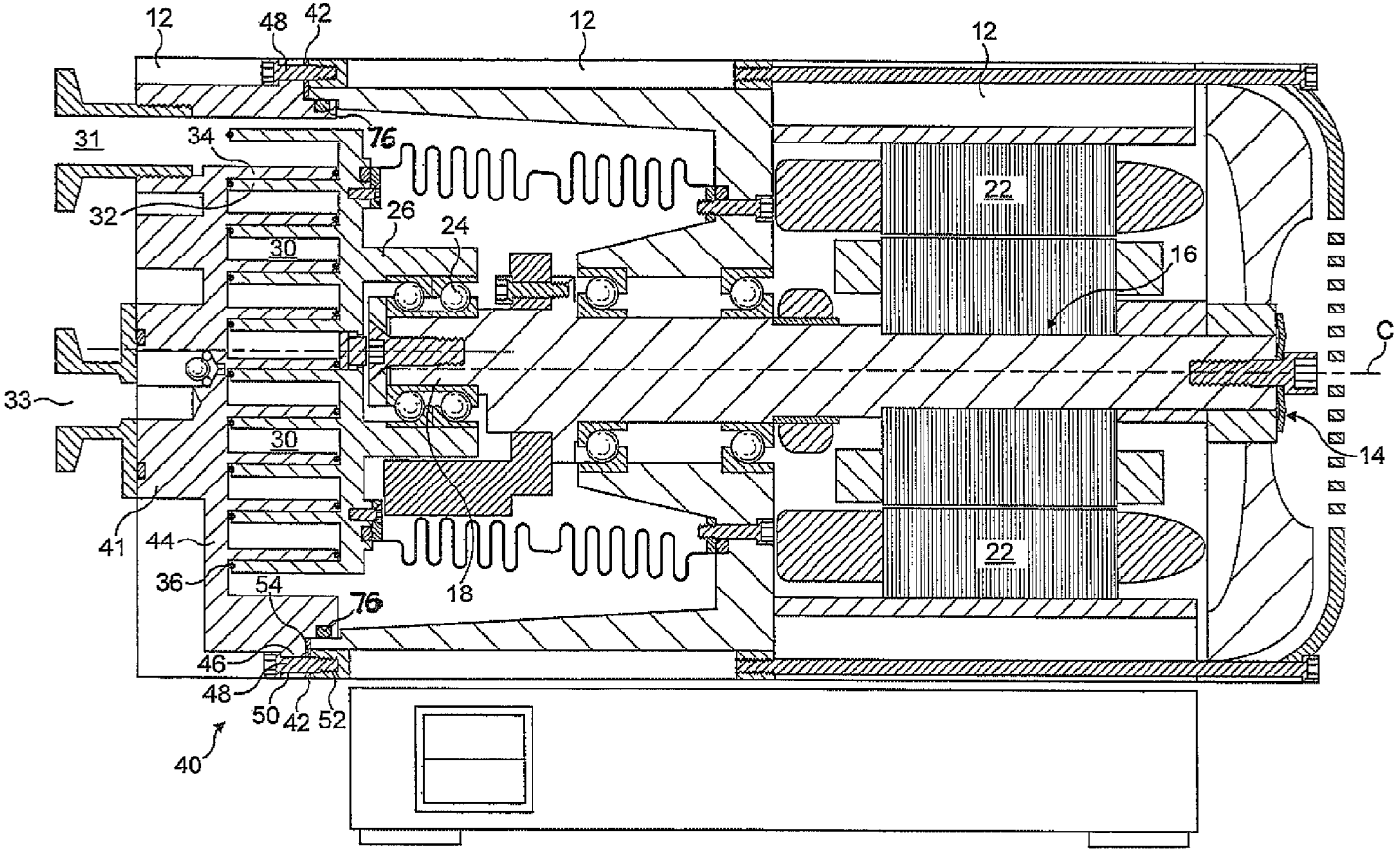
FIG. 1 shows a section through a scroll compressor.

A scroll compressor 40 is shown in FIG. 1. Those features of scroll compressor 40 and scroll compressor 10 which are equivalent and described above in relation to FIG. 5 are given the same reference numerals and will not be described again in detail.

The scroll compressor 40 comprises: housing 12, orbiting scroll 26 and fixed scroll 41. The drive shaft 14 has an eccentric shaft portion 18 so that rotation of the eccentric shaft portion imparts an orbiting motion to the orbiting scroll relative to the fixed scroll. At least one axial spacer 42 is located between the fixed scroll and the housing for spacing the fixed scroll relative to the orbiting scroll. When the scroll compressor 40 is assembled and tested and it is desired to perform shimming, the fixed scroll is removed and a selected spacer is positioned as shown. It is not necessary to remove the orbiting scroll 26 and the bearings 24 to perform shimming and consequently the procedure is less time consuming than the procedure described above in relation to the compressor shown in FIG. 5.

Only a single axial spacer is required for spacing the fixed scroll relative to the orbiting scroll. If only a single spacer is provided, the spacer is preferably annular. In a preferred arrangement, a plurality of axial spacers 42 are located at generally equal angles one from an adjacent spacer about a circumference of the fixed scroll 41. In the FIG. 1 arrangement, four axial spacers 42 are provided at approximately 90 degrees one from an adjacent spacer around the fixed scroll 41. Only two such spacers can be seen in FIG. 1. Further, in the FIG. 1 arrangement, four axial spacers 42 are located at generally equal angles about fixed scroll 41 with respect to the central axis C of scroll compressor 40, and a respective axial spacer of the four axial spacers 42 is located at each respective location of a plurality of locations about the central axis C of scroll compressor 40.

The fixed scroll 41 comprises a radially inner portion which co-operates with the orbiting scroll 26 and a radially outer portion which is fixed to the housing 12. The radially inner portion consists generally of a circular base plate 44 and a fixed scroll wall 34 extending perpendicular therefrom. The outer radial portion of the fixed scroll comprises a radially outwardly extending annular flange 46 for fixing to the housing 12. The flange 46 comprises four through-bores 50 and the housing comprises four complimentary closed bores 52 for receiving respective fastening members 48 for fastening the flange to the housing 12.

Figure 2:
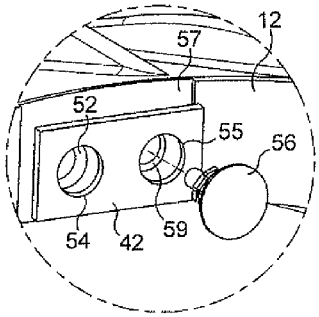
FIG. 2 is a perspective view of a spacer prior to location in the housing of the scroll compressor.
Figure 3:
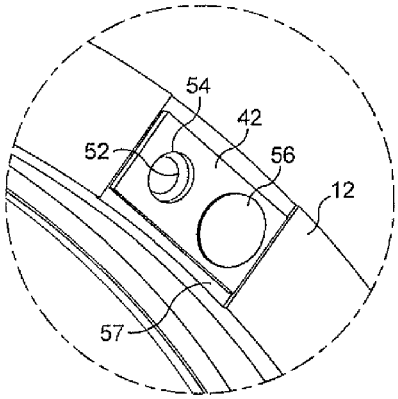
FIG. 3 is a perspective view of the spacer in location.
Figure 4:
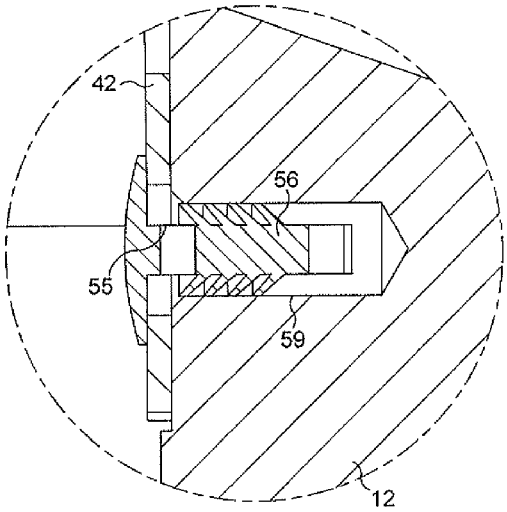
FIG. 4 is a cross-section showing the spacer in location.

As shown more particularly in FIGS. 2 to 4 in addition to FIG. 1, each spacer 42 comprises a first through-bore 54 adapted for alignment with the through bore 50 of the flange 46 and the closed bore 52 of the housing 12 for receiving respective fastening members 48 for fixing the spacers 42 in location between the fixed scroll 41 and the housing 12. The spacers 42 comprise a second through-bore 55 for receiving a retaining member 56 for retaining the spacers in position prior to fixing the flange to the housing. As shown in FIGS. 2 and 3, the spacers 42 are located in a recess 57 of the housing 12 to prevent sideways movement of the spacers in a circumferential direction. Retaining members 56 are inserted through through-bores 55 and engage in second closed bores 59 of the housing. The retaining members 56 may be provided with a number of resilient barbs for engaging with the housing 12 in closed bores 59. The arrangement of the retaining members 56 and the recesses 57 serve to retain the spacers in position prior to fixing the fixed scroll to the housing.

Although not shown in the drawings, the flange 46 of the fixed scroll comprises a plurality of recesses which accommodate the heads of the retaining members when the fixed scroll is fixed to the housing. Accordingly, the flange can be seated flush against the spacers and therefore axial spacing of the fixed scroll can be controlled solely by the spacers.

If only a single annular spacer is provided, although this is not currently preferred, it is located at an outer radial portion of the fixed scroll. Accordingly, if the axial end faces of the spacer are not exactly parallel to each other, the effect on the angular alignment of the fixed scroll relative to the orbiting scroll is relatively small, particularly when compared to the prior art arrangement.

In the preferred embodiment as shown in FIGS. 1 to 4, the axial spacing of the fixed scroll from the orbiting scroll is controlled by selecting each of four spacers with appropriate and equal axial thickness. For example, if it desired to move the fixed scroll an axial distance of 25 μm away from the orbiting scroll, then four spacers of 25 μm are fixed between the fixed scroll 41 and the housing 12. If any of the spacers are not exactly 25 μm, due to manufacturing errors, it has relatively little effect on the angular alignment of the fixed scroll since each of the axial spacers 42 are located at the outer radial portion of the fixed scroll and are therefore a relatively large distance from central axis C.

Furthermore, in the arrangement shown in FIGS. 1 to 4, it is possible actively to control the angular alignment, or 'lean', of the fixed scroll by fixing selected spacers with different thicknesses between the fixed scroll and the housing thereby creating an angle between the fixed scroll and the housing. For example, angular alignment can be achieved by locating a spacer of increased thickness at a first recess 57 and locating a spacer of decreased thickness at a diametrically opposite recess 57.

As used herein, references to spacing and spacing in an axial direction are intended to refer both to spacing of the whole of the fixed scroll in the axial direction (i.e. shifting the fixed scroll to the right or left as shown in FIG. 1) and also to spacing of portions of the scroll in the axial direction to correct angular alignment. It will be appreciated that in correctly shimming a compressor it may be required to control both forms of axial spacing by selection of suitable spacers.

As the spacers 42 are located at an outer radial portion of the fixed scroll, changes to the thickness of the spacers 42 produce relatively small changes in the angular alignment of the fixed scroll. The angular displacement is approximately equal to the $\tan^{-1}$ of the nominal thickness of the spacer divided by the distance of the spacer from the central axis C. Accordingly, it is possible to achieve accurate shimming of the fixed scroll whilst using spacers with larger tolerances on thickness and which are relatively more thick, and easy to handle and use, than compared to the prior art. Since it is possible to set the spacing of the fixed scroll from the orbiting scroll more accurately, it is possible to design the compressor with reduced running clearances, which improves overall efficiency.

In the FIG. 1 arrangement, each spacer 42 is formed of a discrete circumferential or straight tangential segment. As each spacer is relatively short compared to the entire circumference of the fixed scroll, it is possible to adjust the fixed scroll to achieve angular alignment whilst maintaining sufficient contact area between the fixed scroll and the spacers. In this regard, preferably each spacer has an angular extent with respect to the circumference of the fixed scroll of no more than about 20 degrees. In this way, the contact area between the spacers and the fixed scroll can be adequately maintained given first the relatively small angles which are generated in practice between the fixed scroll and the housing after angular alignment and second the small amount of flexibility of the components.

Figure 5:
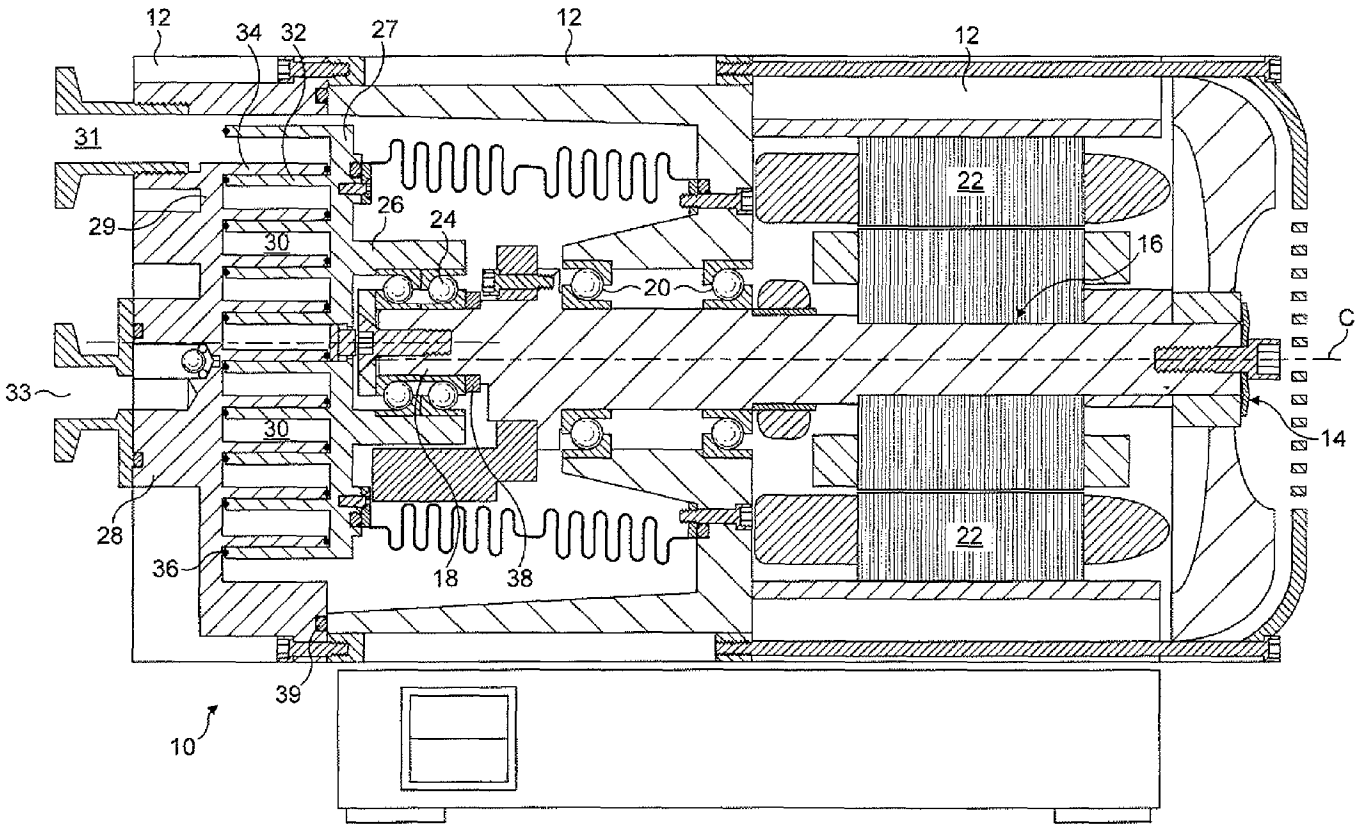
FIG. 5 (Prior Art)
FIG. 5 shows a section through a prior art scroll compressor.

In the prior art compressor shown in FIG. 5, the fixed scroll 28 can be fixed relative to the housing in one position only. Accordingly, the interface between the fixed scroll and the housing is sealed with an o-ring which is compressed against an axial end face of the housing when the fixed scroll is fixed to the housing. In the FIG. 1 compressor, the fixed scroll 41 can be spaced relative to the housing in any one of plurality of different relative positions in the axial direction. Accordingly, in order to seal between the surfaces, the fixed scroll 41 comprises a recess which opens in a radial direction and receives an o-ring 76 which is compressed against an inwardly facing surface of the housing. In this way, the o-ring 76 can seal the interface between the fixed scroll and the housing in a plurality of relative positions of the fixed scroll and the housing.

In FIG. 1, the fixed scroll 41 and the orbiting scroll 26 are each formed as a unitary structure, for instance by casting. However, each of the scrolls may be formed from more than one piece. For example the radially inner portion of the fixed scroll may be formed from one piece and the radially outer portion of the fixed scroll may be formed from another piece.

The scroll compressor may be supplied in the form of a kit comprising a plurality of spacers 42 of different thicknesses for assembling or adjusting the spacing of the fixed scroll 41 from the housing 12 by different respective axial distances. Spacers of the appropriate thickness can be selected and located between the fixed scroll and the housing for correctly spacing the fixed scroll 41 from the orbiting scroll 26. For a scroll of typical size, the kit may be supplied with spacers of between 1 mm and 10 mm in increments of anything between about 25 μm and 100 μm. In a particular example, spacers are provided between 5.725 mm to 6.025 mm thick in increments of 25 μm. Advantageously, the kit is provided with a combination of two types of spacers. The spacers in the first type are relatively thin and are for producing fine incremental changes. The spacers of the second type are relatively thick and are for producing relatively coarse incremental changes. The spacers in the second type may increase for example from about 1 mm to 2 mm in increments of 100 μm. The first type consists of spacers of 25, 50 and 75 μm. Accordingly, whilst requiring fewer spacers as a whole, the first and second types of spacers can be used in combination to achieve any selected spacing between 1 mm and 2 mm at 25 μm increments.

If a combination of first and second types of spacer is used, as the first type of spacers is thinner and more fragile, the spacers of the second type are mounted over and protect the spacers of the first type thereby preventing damage during assembly. It is undesirable to provide spacers with a thickness of less than 25 μm to minimize the risk of damage to the spacers during handling and to reduce the risk of operators cutting themselves.

A method of assembling scroll compressor 40 will now be described. The method comprising the following steps carried out sequentially. The orbiting scroll 26 is supported by bearings 24 relative to the eccentric shaft portion 18 of the drive shaft 14. The axial spacers are located in position relative to the housing in recesses 57 and retained with retaining members 56. The fixed scroll is fixed to the housing with fastening members 48 such that the axial spacing between the fixed scroll 41 and the orbiting scroll 26 is determined by the axial thickness of the axial spacers.

The axial spacing and angular alignment between the fixed scroll 28 and the orbiting scroll 26 can be adjusted by removing the fixed scroll from the housing 12, replacing one or more of the axial spacers between the housing and the fixed scroll with further axial spacers of different axial thickness, and fixing the fixed scroll to the housing.

Whilst a scroll compressor is typically operated for pumping fluid, instead it can operated as a generator for generating electrical energy when pressurised fluid is used to impart an orbiting motion to the orbiting scroll relative to the fixed scroll. The present invention is intended to cover use of the scroll compressor for pumping and energy generation.

What is claimed is:

1. A method comprising:

removing a fixed scroll from a housing of a scroll compressor comprising the fixed scroll and an orbiting scroll;

replacing a first axial spacer from a plurality of axial spacers between the housing and the fixed scroll with a replacement axial spacer, wherein the replacement axial spacer defines a different axial thickness than the first axial spacer, and wherein the plurality of axial spacers and the replacement axial spacer define a spacing in an angular alignment between the fixed scroll and the orbiting scroll of a scroll compressor, and wherein a respective axial spacer of the plurality of axial spacers is located at each respective location of a plurality of locations about a central axis of the compressor; and fixing the fixed scroll to the housing.

2. The method of claim 1, wherein respective axial spacers of the plurality of axial spacers are located at generally equal angles with respect to the central axis of the compressor.

3. The method of claim 1, wherein at least one of the housing or the fixed scroll comprises means for locating the plurality of axial spacers in position between the fixed scroll and the housing, and wherein replacing the first axial spacer from the plurality of axial spacers between the housing and the fixed scroll with the replacement axial spacer comprises removing the first axial spacer from a respective one of the means for location the plurality of axial spacers and locating the replacement axial spacer.

4. The method of claim 1, wherein each of the plurality of axial spacers and the replacement axial spacer comprises a bore therethrough, and wherein fixing the fixed scroll to the housing comprises disposing a fastening member through each respective bore to fasten the fixed scroll to the housing.

5. A kit for assembling a scroll compressor comprising:

a housing;

an orbiting scroll;

a fixed scroll, wherein at least one of the housing or the fixed scroll comprises a plurality of means for locating a respective axial spacer of a plurality of axial spacers in position between the fixed scroll and the housing;

a drive shaft having an eccentric shaft portion so that rotation of the eccentric shaft portion imparts an orbiting motion to the orbiting scroll relative to the fixed scroll; and a plurality of axial spacers of different axial thickness for spacing in an axial direction and angularly aligning the fixed scroll and the orbiting scroll, and wherein a respective means for locating of the plurality of means for locating the respective axial spacer of the plurality of axial spacers is located at each respective location of a plurality of locations about a central axis of the compressor.

* * * * *